US010612787B2

(12) United States Patent
Wang et al.

(10) Patent No.: US 10,612,787 B2
(45) Date of Patent: Apr. 7, 2020

(54) AUTOMATIC FIREWOOD FEEDING DEVICE AND METHOD

(71) Applicant: BOE TECHNOLOGY GROUP CO., LTD., Beijing (CN)

(72) Inventors: Chongshan Wang, Beijing (CN); Qi Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/744,968

(22) PCT Filed: Jul. 26, 2017

(86) PCT No.: PCT/CN2017/094505
§ 371 (c)(1),
(2) Date: Jan. 15, 2018

(87) PCT Pub. No.: WO2018/032950
PCT Pub. Date: Feb. 22, 2018

(65) Prior Publication Data

US 2019/0162415 A1 May 30, 2019

(30) Foreign Application Priority Data

Aug. 15, 2016 (CN) ..... 2016 1 0672116

(51) Int. Cl.
*F23B 30/00* (2006.01)
*F24B 13/04* (2006.01)
(Continued)

(52) U.S. Cl.
CPC ..... *F24B 13/04* (2013.01); *F23B 50/02* (2013.01); *F23K 3/16* (2013.01)

(58) Field of Classification Search
CPC ..... F24B 13/04; F24B 50/02
See application file for complete search history.

(56) References Cited

U.S. PATENT DOCUMENTS 4,444,538 A * 4/1984 Manley ..... F24B 1/199 110/101 C
4,606,282 A * 8/1986 Steindal ..... F23B 1/16 110/116

(Continued)

FOREIGN PATENT DOCUMENTS

CN 2434566 Y 6/2001
CN 202470037 U 10/2012

OTHER PUBLICATIONS

International Search Report and Written Opinion in PCT/CN2017/094505 dated Nov. 1, 2017.
1st Office Action in 201610672116.9 dated Oct. 17, 2018.

*Primary Examiner* — Jason Lau
(74) *Attorney, Agent, or Firm* — Syncoda LLC; Feng Ma

(57) ABSTRACT

The present disclosure provides an automatic feeding device that can automatically feed a material to a target place. The device comprises a rack, at least one locking member which are attached onto the rack, and a controller. Each of the at least one locking members is configured to maintain a bundle of the material onto the rack in a locked state, and to release the bundle of the material from the rack in an unlocked state; and the controller is coupled to, and configured to control, each of the at least one locking member to be in the unlocked state based on a feeding command. The material can be firewood, and the target place can be a fire, and the device as such can further include a temperature sensor, disposed on the rack and coupled to the controller.

17 Claims, 10 Drawing Sheets

(51) Int. Cl.
*F23K 3/16* (2006.01)
*F23B 50/02* (2006.01)

(56) References Cited

U.S. PATENT DOCUMENTS

| | | | | |
|---|---|---|---|---|
| 4,688,544 | A * | 8/1987 | Gonzales | F24B 13/04<br>110/101 C |
| 2011/0017190 | A1* | 1/2011 | Cardenas Silva | F23B 40/00<br>126/4 |
| 2013/0137052 | A1* | 5/2013 | Laskowski | F23N 1/02<br>431/12 |

* cited by examiner

AUTOMATIC FIREWOOD FEEDING DEVICE AND METHOD

CROSS-REFERENCE TO RELATED APPLICATION

The present application claims priority to Chinese Patent Application No. 201610672116.9 filed on Aug. 15, 2016, the disclosure of which is hereby incorporated by reference in its entirety.

TECHNICAL FIELD

The present disclosure relates generally to a field of fuel supply technologies, and specifically to an automatic firewood feeding device and an automatic firewood feeding method.

BACKGROUND

With an increasingly improvement of living standards, outdoor activities, such as traveling in the field, have become more and more popular among people. Camping is a necessary part of leisure and entertainment during a travel in the field. During camping in the wild, fires (i.e. campfires) are usually needed for cooking, keeping people warm, and/or for driving wild animals off.

During the burning process of a fire, people need to supply or supplement firewood manually and continuously to the fire, in order to maintain the fire burning and to prevent the fire from disappearing or quenching.

As a result, people need to constantly pay attention to the burning status of the fire, and are thus unable to immerse themselves fully into other camping activities. In addition, when people go to sleep in the night, the fire cannot be maintained in the burning status, thus it is disadvantageous for keeping people warm or driving wild animals off and away from the camping sites.

SUMMARY

Embodiments of the present disclosure provide an automatic firewood feeding device, which can automatically add firewood to a fire to thereby keep the fire in burning state for a long time.

In order to achieve the aforementioned purpose, embodiments of the present disclosure adopt the following technical solutions.

In a first aspect, a device for automatically feeding a material to a target place is disclosed herein. The device comprises a rack, at least one locking member which are attached onto the rack, and a controller.

In the device, each of the at least one locking members is configured to maintain a bundle of the material onto the rack in a locked state, and to release the bundle of the material from the rack in an unlocked state; and the controller is coupled to, and configured to control, each of the at least one locking member to be in the unlocked state based on a feeding command.

Herein, the material can be firewood and the target place can accordingly be a fire. It is noted that the material can be other type of material, and there is no limitation herein.

The device can further include a temperature sensor, which is disposed on the rack and coupled to the controller. The temperature sensor is configured to detect, and send to the controller, a temperature of air in a proximity of the fire; and the controller is further configured to generate the feeding command if the temperature of the fire detected by the temperature sensor is smaller than or equal to a first temperature threshold value.

According to some embodiments of the disclosure, the first temperature threshold value is in a range of around 150° C.–250° C.

In the device as described above, the controller can include a timer, which is configured to trigger the controller to generate a feeding command at a preselected time interval.

In the device, the rack can comprise at least one main support portion and at least one fastening portion. The at least one main support portion stands on a ground and beside the fire. Each of the at least one fastening portion is mounted onto the at least one main support portion and is configured to fasten a bundle of firewood thereonto, and one of the at least one locking member is attached onto each of the at least one fastening portion.

In the device as described above, the at least one main support portion can comprise two and more main support portions in parallel to one another, and the at least one fastening portion is disposed between two adjacent main support portions.

Herein each of the at least one fastening portion can comprise a crossbeam, and each of the at least one locking member can comprise a rope, which is attached to a crossbeam corresponding thereto. The rope is configured to be wound around a bundle of firewood to thereby fasten the bundle of firewood on the crossbeam in the locked state, and to be loosened to thereby release the bundle of firewood from the crossbeam in the unlocked state.

Furthermore, each of the at least one locking member can further comprise a rotary motor. The rotary motor is coupled to the controller, and is configured to rotate in a first direction in the locked state and to rotate in a second direction in the unlocked state. As such, the rope is configured to have one end thereof mounted onto the crossbeam and another end thereof bound onto the crossbeam through a slipknot in the locked state, wherein the another end is wound around a rotating axis of the rotary motor such that rotation of the rotary motor in the first direction tightens the rope to thereby fasten the bundle of firewood on the crossbeam in the locked state; and rotation of the rotary motor in the second direction pulls open the slipknot to thereby release the bundle of firewood from the crossbeam in the unlocked state.

Alternatively, each of the at least one locking member can further comprise two electromagnets. One of the two electromagnets is attached to one end of the rope, and another one of the two electromagnets is mounted onto the crossbeam. The two electromagnets are coupled to the controller, and are configured to be charged to attract each other to thereby fasten the bundle of firewood on the crossbeam in the locked state; and to be uncharged to lose attraction to each other to thereby release the bundle of firewood from the crossbeam in the unlocked state.

According to some embodiments of the disclosure, each of the at least one fastening portion comprises a support panel, which is hinged on, and have a hinge axis perpendicular to, two adjacent main support portions. The support panel is configured to be in a position fastening the bundle of firewood thereon in the locked state, and to rotate around the hinge axis in one direction to thereby release the bundle of firewood therefrom in the unlocked state.

In the embodiments of the device as described above, each of the at least one locking member comprises a rotary motor, is attached to the support panel and is configured to rotate to thereby carry the support panel to rotate around the hinge axis thereof. The rotary motor is coupled to the controller and is configured to rotate in the one direction in the unlocked state.

In any of the embodiments of the device as described above, the device can further include an alarming device, which is coupled to the controller and is configured to generate an alarm upon receiving an alarming command from the controller. The controller is further configured to generate an alarming command if the temperature of the fire detected by the temperature sensor is smaller than or equal to a second temperature threshold value.

Herein the second temperature threshold value can be in a range of around 45° C.-60° C.

In any of the embodiments of the device as described above, the device can further include at least one guiding member. Each of the at least one guiding member is disposed between the fire and the rack such that one end thereof pointing to the rack is placed higher than another end thereof pointing to the fire; and each of the at least one guiding member is configured to guide the bundle of firewood released from the rack to roll into the fire.

Additionally, the above mentioned device can further include at least one baffle board. Each of the at least one baffle board is disposed on a ground, in a guiding direction of one guiding member, and at a side of the fire opposing to the rack, and is configured to baffle the bundle of firewood rolling off the one guiding member to thereby prevent the bundle of firewood from falling off the fire.

According to some embodiments, the device can further include at least one ancillary support bar. Each of the at least one ancillary support bar is disposed on a side of the rack opposing to the fire such that one end thereof attaching the rack is higher than another end thereof touching the ground; and each of the at least one ancillary support bar is configured to support the rack.

In the embodiments of the device where the rack comprises at least one main support portion, each of the at least one main support portion can be configured to have an adjustable length.

In the embodiments of the device where the rack comprises at least one main support portion and at least one fastening portion, the at least one main support portion can include three and more main support portions in parallel to one another, and the at least one fastening portion can be disposed between every two adjacent main support portions. Every two adjacent planes formed by each three adjacent main support portions are configured to have an angled corner pointing to a direction far away from the fire.

In a second aspect, the present disclosure further provides a method for automatically feeding bundles of firewood to a fire. The method includes the following steps:

a temperature sensor detecting, and sending to a controller, a temperature of air in a proximity of the fire;

the controller generating, and transmitting to at least one locking member, a feeding command if the temperature of the fire detected by the temperature sensor is smaller than or equal to a first temperature threshold value; and the at least one locking member switching from a locked state to an unlocked state to thereby release the bundles of firewood from a rack into the fire upon receiving the feeding command from the controller.

According to some embodiments, the method further includes the following two steps:

the controller generating, and transmitting to an alarming device, an alarming command if the temperature of the fire detected by the temperature sensor is smaller than or equal to a second temperature threshold value; and the alarming device generating an alarm upon receiving an alarming command from the controller.

In the method, each of the at least one locking member comprises a rope. As such, the step of at least one locking member switching from a locked state to an unlocked state to thereby release the bundles of firewood from a rack into the fire upon receiving the feeding command from the controller comprises a sub-step of:

the rope being loosened to thereby release the bundle of firewood from the rack.

In the method as described above, each of the at least one locking member can further comprise a rotary motor, coupled to the controller. One end of the rope in a slipknot is wound around a rotating axis of the rotary motor in the locked state; and as such, prior to the step of the rope being loosened to thereby release the bundle of firewood from the rack, the step of at least one locking member switching from a locked state to an unlocked state to thereby release the bundles of firewood from a rack into the fire upon receiving the feeding command from the controller further comprises a sub-step of:

the rotary motor rotating to pull open the slipknot to thereby loosen the rope.

In the method as described above, each of the at least one locking member can further include two electromagnets, coupled to the controller, wherein one of the two electromagnets is attached to one end of the rope, and another one of the two electromagnets is mounted onto the crossbeam. As such, prior to the step of the rope being loosened to thereby release the bundle of firewood from the rack, the step of the at least one locking member switching from a locked state to an unlocked state to thereby release the bundles of firewood from a rack into the fire upon receiving the feeding command from the controller further comprises a sub-step of:

the two electromagnets being uncharged to lose attraction to each other to thereby loosen the rope.

In the method, each of the at least one locking member can include a support panel and a rotary motor, wherein the rotary motor is coupled to the controller and is configured to carry the support panel to rotate around a hinge axis thereof. As such, the step of the at least one locking member switching from a locked state to an unlocked state to thereby release the bundles of firewood from a rack into the fire upon receiving the feeding command from the controller comprises a sub-step of:

the rotary motor rotating to thereby release the bundle of firewood from the support panel.

In the method, the first temperature threshold value can be in a range of around 150° C.-250° C.; and the second temperature threshold value can be in a range of around 45° C.-60° C.

BRIEF DESCRIPTION OF DRAWINGS

To more clearly illustrate some of the embodiments, the following is a brief description of the drawings. The drawings in the following descriptions are only illustrative of some embodiments. For those of ordinary skill in the art, other drawings of other embodiments can become apparent based on these drawings.

DETAILED DESCRIPTION

In the following, with reference to the drawings of the embodiments disclosed herein, the technical solutions of the embodiments of the invention will be described in a clear and fully understandable way. It is noted that the described embodiments are merely a portion but not all of the embodiments of the invention. Based on the described embodiments of the invention, those ordinarily skilled in the art can obtain other embodiment(s), which come(s) within the scope sought for protection by the invention.

In order to address the problems in maintaining a fire as described above, the present disclosure provides an automatic firewood feeding device.

Figure 1:
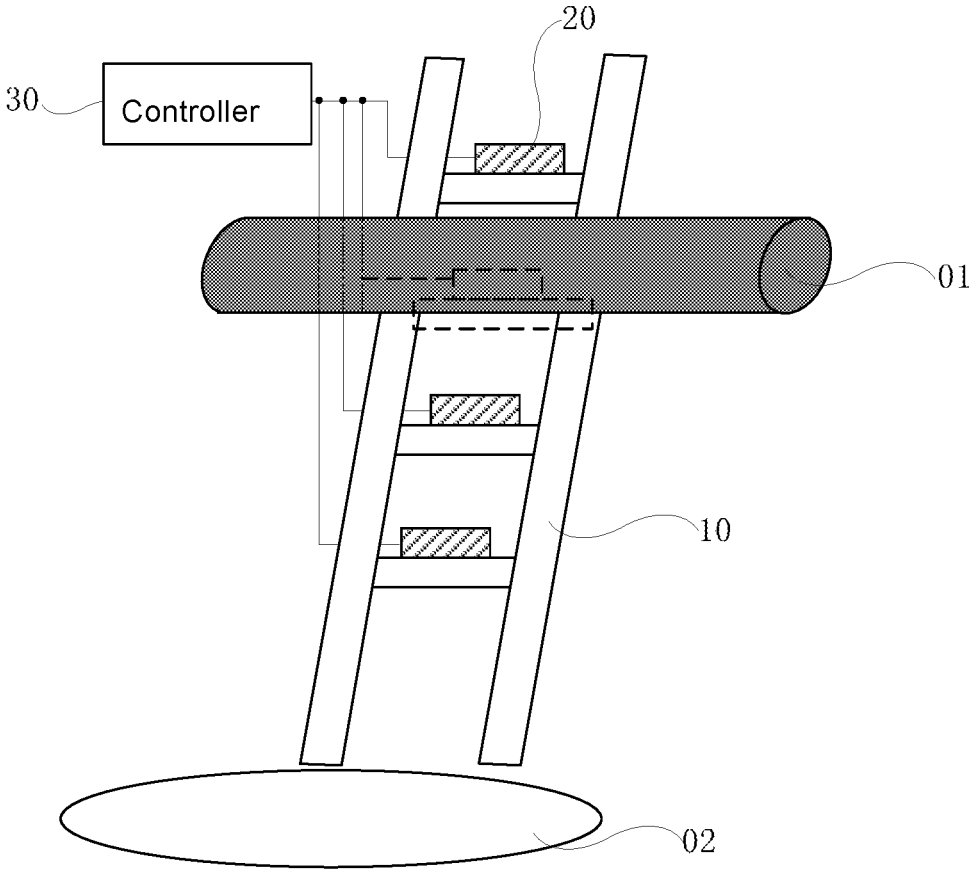
FIG. 1 is a structural diagram of an automatic firewood feeding device provided by some embodiments of the present disclosure.

FIG. 1 illustrates an automatic firewood feeding device according to some embodiments of the disclosure. As shown in FIG. 1, the automatic firewood feeding device comprises a rack 10, and at least one locking member 20 disposed on the rack 10. Each locking member 20 is configured to attach or fasten a firewood bundle 01 on the rack 10 in a locked state, and to detach/release the firewood bundle 01 from the rack 10 in an unlocked state.

The automatic firewood feeding device further comprises a controller 30. The controller 30 is disposed over the rack 10 and is coupled to each of the locking members 20. The controller 30 is configured to control the locking members 20 to be in the unlocked state according to a feeding command, such that when it is required to supplement firewood to the fire 02, the locking members 20 are unlocked under the control of the controller 30 to thereby detach the firewood bundles 01 from the rack 20. After detachment from the rack 20, the firewood bundles 01 fall into the fire 02.

It should be noted that the feeding commands can be set manually. For example, when the controller 30 comprises a timer, the timer can be set manually by people around the campsite. For instance, the controller 30 can be triggered to generate a feeding command at a time interval of one hour, so that the controller 30 can control the locking members 20 to be in the unlocked state according to the feeding command.

Herein, the time interval of the timer can be set depending on the practical needs. For example, the time interval can be set to be shorter in winter, or set to be longer in summer.

Figure 9:
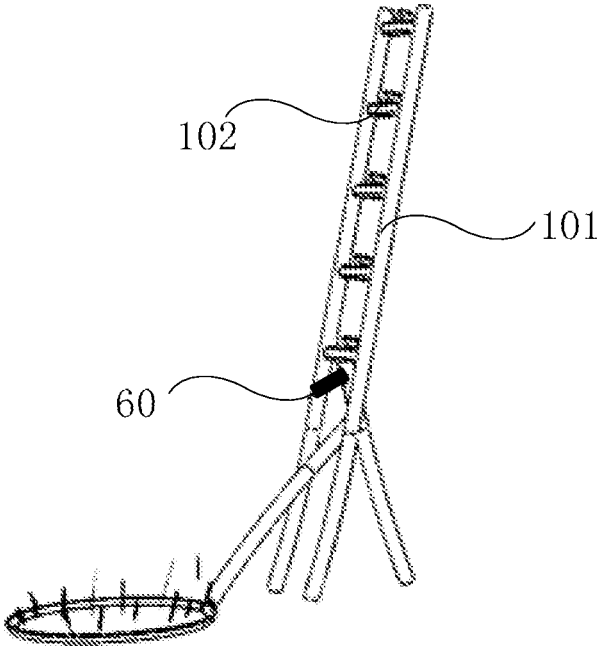
FIG. 9 is structural diagram of the automatic firewood feeding device configured with the temperature sensor and the alarming device.

According to some embodiments of the present disclosure, the automatic firewood feeding device further comprises a temperature sensor 60. As shown in FIG. 9, the temperature sensor 60 is coupled, or connected, to the controller 30. The temperature sensor 60 is configured to detect a temperature of air in a proximity of the fire 02 and to output a detection result (i.e., detected temperature) to the controller 30.

If the detected temperature received by the controller 30 is smaller than, or equal to, a first temperature threshold value T1, the controller 30 generates a feeding command. Herein, the range of the first temperature threshold value T1 is 150° C.-250° C.

As such, if the detected temperature received by the controller 30 is lower than, or equal to, the first temperature threshold value T1, it indicates that an intensity of the fire 02 is reduced, and thus firewood bundles 01 are needed to be supplemented to the fire 02 to thereby maintain the intensity of the fire 02.

Therefore, the controller 30 can generate feeding commands according to the temperature that are detected by the temperature sensor 60, so that the controller 30 can control the locking members 20 to be in the unlocked state based on the feeding commands.

Thus in the automatic firewood feeding device as described above, the locking members are configured to fasten or attach the firewood bundles over the rack in a locked state, and to release the firewood bundles from the rack in an unlocked state. The controller is configured to control the locking members to be in the unlocked state according to the feeding commands.

As such, by means of the controller, the firewood bundles can be controlled to be released/detached from the rack according to the feeding commands and then fall into the fire, so that the firewood can be supplemented automatically to the fire. Thereby, the fire can be maintained in the burning state for a long time without the need for manual operations during the firewood feeding process.

In addition, because the fuel of the automatic firewood feeding device is wood, and the wood can be obtained locally and conveniently, there is no need for people to carry inflammable fuels such as natural gas, alcohol, diesel fuel, or liquefied petroleum gas.

Figure 2:
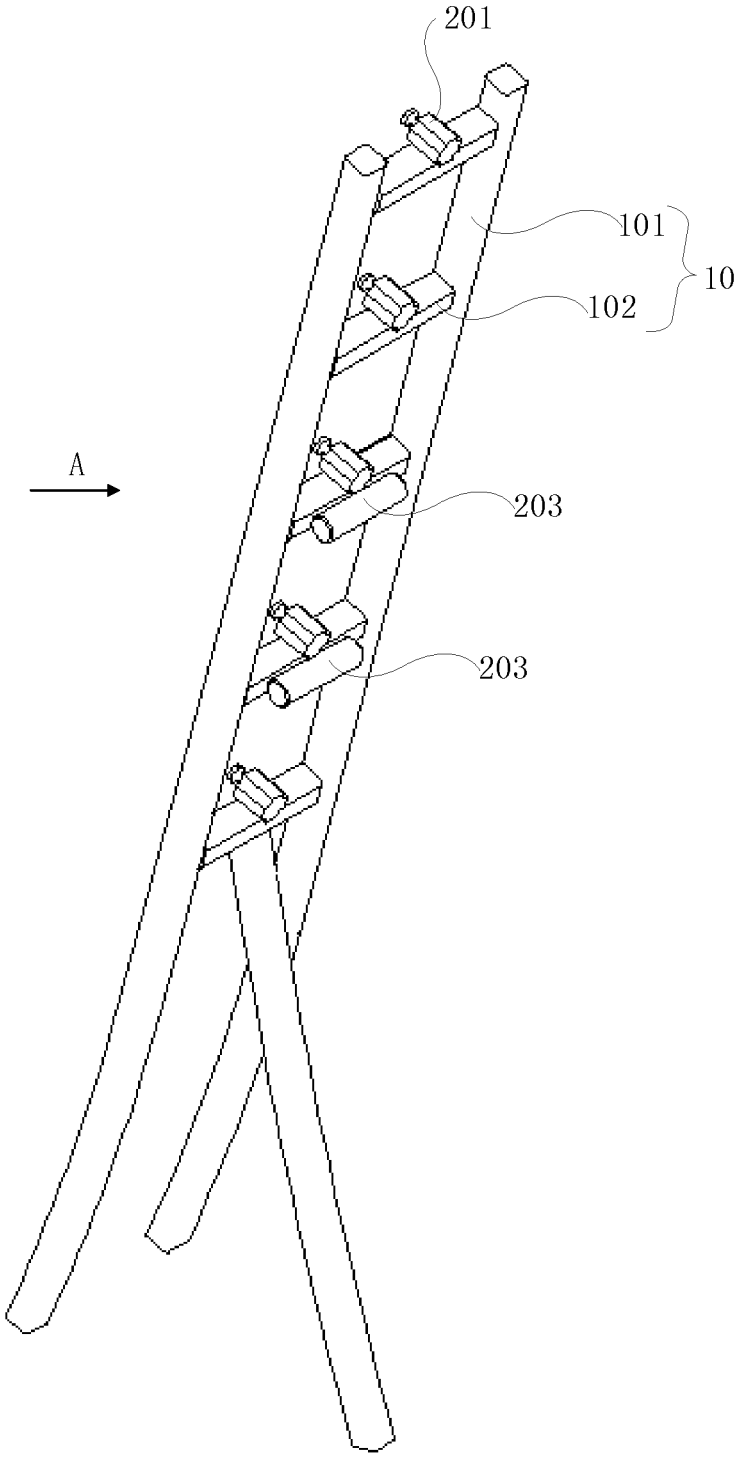
FIG. 2 is a structural diagram of the rack in FIG. 1.

In some embodiments of the automatic firewood feeding device, as illustrated in FIG. 2, the rack 10 includes two main support portions 101 and a plurality of fastening portions 102. The two main support portions 101 are arranged to be parallel to one another, and the plurality of fastening portions 102 are each disposed between two adjacent main support portions 101.

In the automatic firewood feeding device as shown in FIG. 2, each main support portion 101 substantially takes a shape of a support bar, and the plurality of fastening portions 102 substantially form parallel connecting bars disposed between the two support bars (i.e., the two main support portion 101). As such, the two main support portions 101 and the plurality of fastening portions 102 together substantially form a ladder-like structure.

It should be noted that there are no limitations to the number, shape, or configuration of the main support portions 101 and the plurality of fastening portions 102 in the rack 10 of the automatic firewood feeding device disclosed herein.

In the one embodiment as illustrated in FIG. 2, the rack 10 includes two main support portions 101, and the plurality of fastening portions 102 are disposed in parallel between the two main support portions 101.

Figure 3:
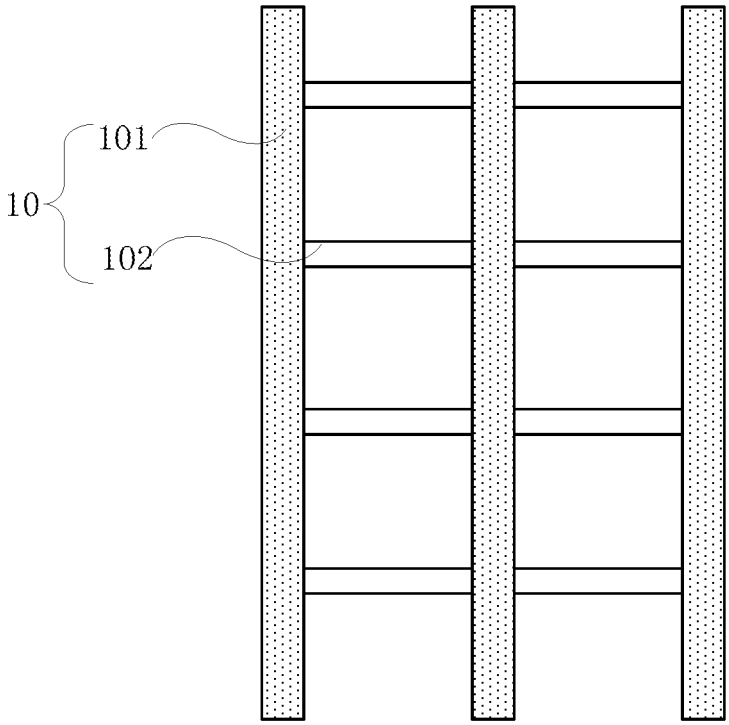
FIG. 3 is another structural diagram of the rack in FIG. 1.
Figure 4:
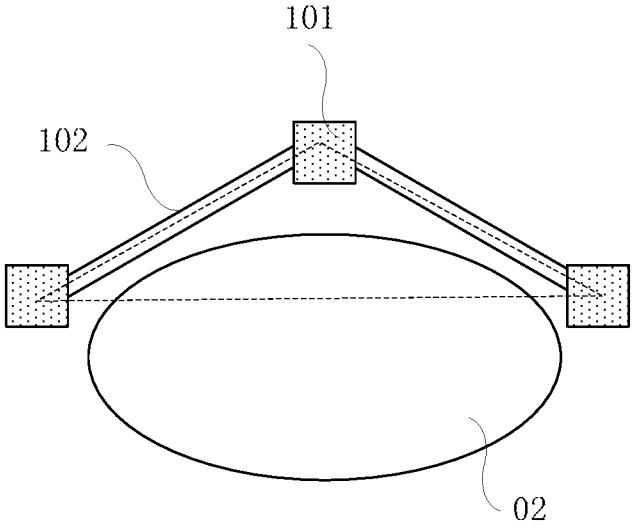
FIG. 4 is a top view of the rack in FIG. 3.

In yet other embodiments as illustrated in both FIG. 3 and FIG. 4, the rack 10 includes three main support portions 101, and between two adjacent main support portions 101, a plurality of fastening portions 102 are disposed in parallel.

In yet another embodiment (not shown in the drawings), the rack 10 may include only one main support portion 101, and different points along the main support portion 101 provide mounting points for the plurality of fastening portions 102, on which the firewood bundles are each attached.

In yet another embodiment (not shown in the drawings), the rack 10 may include only one main support portion 101, and different points along the main support portion 101 provide mounting points directly for the firewood bundles 01. Thus in the embodiments described herein, there are no fastening portions 102 on the rack 10.

It is noted that the two embodiments as illustrated respectively in FIG. 3 and FIG. 4 have different configurations: the three main support portions 101 are located in a same plane in the embodiment as shown in FIG. 3, whereas the three main support portions 101 are located in different planes in the embodiment as shown in FIG. 4.

Additionally, in the embodiment as shown in FIG. 4, the area of the fire is relatively small, and the projections of the three main support portions 101 on the ground form three corners of a triangle. By this configuration, the rack 10 can surround the fire 02 as much as possible, and the firewood bundles 01 attached on the fastening portions of the rack 10 can easily fall into the fire 02.

In the three embodiments as shown in FIGS. 2-4, each main support portion 101 and each fastening portion 102 take a shape of a bar which is substantially straight, yet it is possible that each main support portion 101 and each fastening portion 102 can take a curved shape, or other shapes as well.

In order to improve the stability of the rack 10 when it is placed on the ground, preferably a plurality of racks can be arranged to be parallel to one another.

In the automatic firewood feeding device as disclosed herein, the main support portions 101 are configured to install the fastening portions 102 thereon, and to support the firewood bundles 01 that are attached on the fastening portions 102. The more the fastening portions 102 that are disposed on the main support portions 101, the more firewood bundles 01 can be fastened.

In the automatic firewood feeding device as described above, each of the plurality of firewood bundles 01 is fastened over one of the plurality of fastening portions 102, and each fastening portion 102 comprises a locking member 20, which is configured to control a supplementation of the fuel (i.e., the firewood bundles 01) to the fire 02, thereby prolonging the time period of maintaining the intensity of the fire 02.

Specifically, each of the plurality of firewood bundles 01 is fastened over the rack 10 via the fastening portions 102. In one supplementation mode, under control of the controller 30, the locking members 20 arranged over the fastening portions 102 can switch from the locked state to the unlocked state one after another in an order from the bottom to the top, such that the plurality of firewood bundles 01 can fall into the fire 02 sequentially.

In another supplementation mode, under control of the controller 30, all of the locking members 20 arranged over the fastening portions 102 can switch from the locked state to the unlocked state at the same time, such that the plurality of firewood bundles 01 can fall into the fire 02 at the same time.

It is noted that besides the two supplementation modes as described above, it is possible to have other supplementation modes, depending on practical needs. For example, in one possible supplementation mode, the controller 30 can control a first subset of the locking members 20 to switch from the locked state to the unlocked state to thereby allow a large amount of firewood bundles to the fire 02 at the same time, but can also control a second subset of the locking members 20 to switch from the locked state to the unlocked state one after another in an order from bottom to top, thereby allowing the firewood bundles to be supplemented to the fire 02 and gradually.

Furthermore, if there is a need for a relatively large number of the fastening portions 102 disposed between two neighboring main support portions 101, the main support portions 101 can be configured to be longer.

In order to conveniently carry the automatic firewood feeding device whose rack 10 has a relatively large number of fastening portions 102, each of the main support portions 101 can be configured to have an adjustable length.

Figure 5:
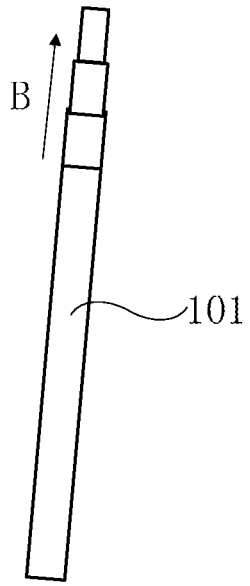
FIG. 5 is a structural diagram of the main support portion in FIG. 2.

In some embodiments of the present disclosure, each of the main support portions 101 can be configured to be extendable, as illustrated in FIG. 5, where the main support portions can be extended to have a larger length or be retracted to have a smaller length along the direction B.

In some other embodiments of the present disclosure, each of the main support portions 101 can be configured to be foldable (not shown in the drawings). Specifically, each of the main support portions 10 comprises a plurality of segments, wherein each segment is connected to an adjacent segment via a hinge, and is configured to be foldable around the hinge, such that the whole main support portion 10 together can take a different length.

In yet some other embodiments of the present disclosure, each of the main support portions 101 can be configured to comprise detachable segments (not shown in the drawings). Specifically, each of the main support portions 10 comprises a plurality of detachable segments, which are configured to be able to assembled into a whole support bar with a longer length during deployment and are also configured to be disassembled into individual separated segments otherwise.

It is noted that these above different embodiments can be each individually or combinatorially applied in one automatic firewood feeding device. There are no limitations herein.

To further increase the portability of, or the convenience in carrying the automatic firewood feeding device, the fastening portions 102 can also be configured to be detachable, embeddable, or foldable, depending on specific design and practical needs.

In the following, the specific structures of the fastening portions 102 are illustrated with examples in which the rack 10 comprises the main support portions 101.

Embodiment 1

In this embodiment, each of the fastening portions 102 comprises a crossbeam. In the rack 10 as illustrated in FIG. 2, the plurality of the fastening portions 102 disposed between each two neighboring main support portions substantially comprise a plurality of crossbeams, arranged to be parallel to one another.

Figure 6:
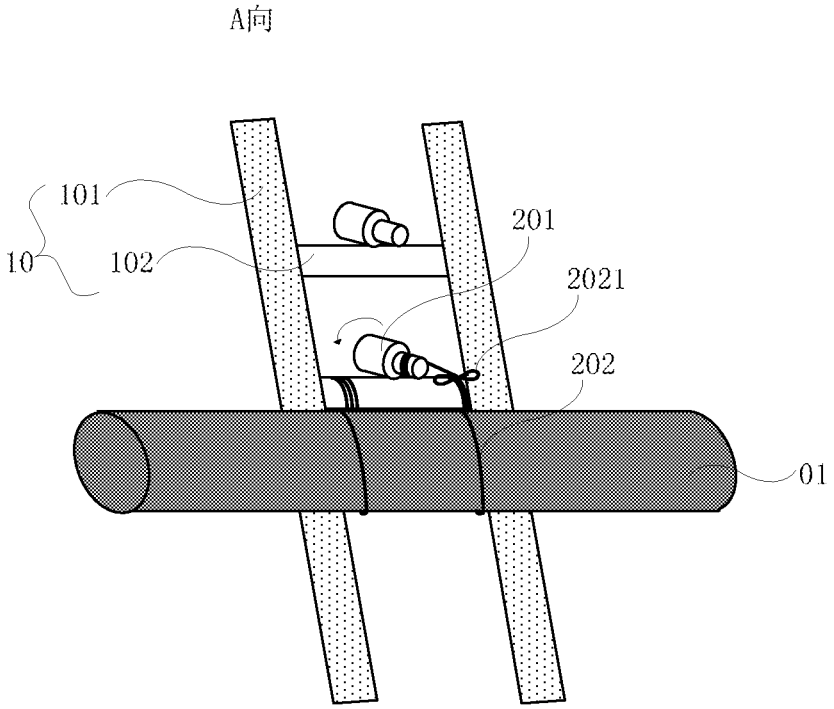
FIG. 6 is a diagram of the locking member provided by embodiments of the present disclosure.

Each locking member 20 that is disposed over the fastening portions 102 includes a rotary motor 201 that is coupled to the controller 30 as illustrated in FIG. 1, and further includes a rope 202 as illustrated in FIG. 6.

As such, the configuration whereby the locking members 20 lock the firewood bundles 01 over the rack 10 in a locked state, and detach the firewood bundles 01 from the rack 10 in an unlocked state can be illustrated with the following example.

In this example, the rope 202 can be wound around the firewood bundles 01. Specifically, one end of the rope is mounted or attached onto the crossbeam (i.e., the fastening portion 102), and the other end of the rope is bound onto the crossbeam through a slipknot 2021. One portion of the rope 202 at an opening end (the slipknot 2021 end) is configured to be wound, or wrapped, around a rotating axis of the rotary motor 201.

As such, if the controller 30 generates a control signal according to the feeding commands, the control signal can be outputted to the rotary motors 201 through a wired or wireless approach (e.g., Bluetooth, wireless LAN, etc.), which controls the rotating axis of the rotary motors 201 to rotate in one direction (illustrated by the arrow in FIG. 6).

Figure 7:
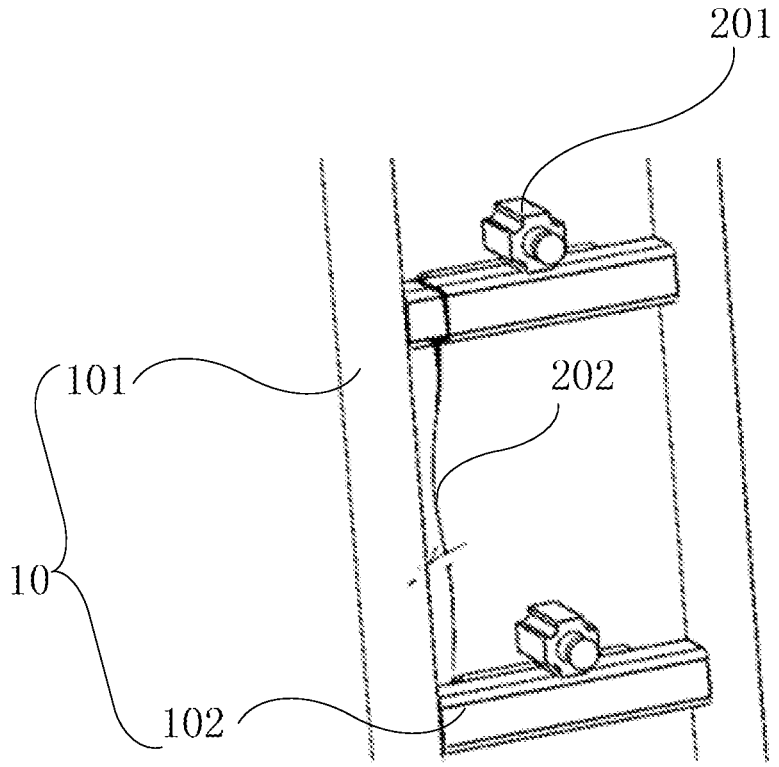
FIG. 7 is a diagram illustrating the unlocked state of the locking member in FIG. 6.

Rotation of the rotating axis of the rotary motors 201 pulls the opening end of the slipknot 2021 to thereby open the slipknots 2021, allowing the firewood bundles 01 to be detached from the ropes 202 that are wound around the firewood bundles 201, as illustrated in FIG. 7. Consequently, the firewood bundles 01 are detached from the crossbeams, and subsequently fall into the fire 02 under gravity.

In the above way of fastening the firewood bundles 01 over the crossbeams through the slipknots 2021 of the ropes 202, the crossbeams are the primary component to bear weights of the firewood bundles 01, thus only a small amount of power is needed for the rotary motors 201 to open the slipknots. As such, there is no need to configure a big and powerful rotary motors 201 for such a purpose.

In addition, the plurality of rotary motors 201 located over different crossbeams can be configured to share a common energy storage device. In one illustrating embodiment as shown in FIG. 2, the storage device comprises two batteries 203. The batteries 203 can be directly mounted on the crossbeams or the main support portions 101, and can be connected to the different rotary motors 201 through wiring inside the crossbeams or the main support portions 101. In order to protect the batteries 203, a cover can be configured to contain and protect the batteries 203 (not shown in figures).

Figure 8:
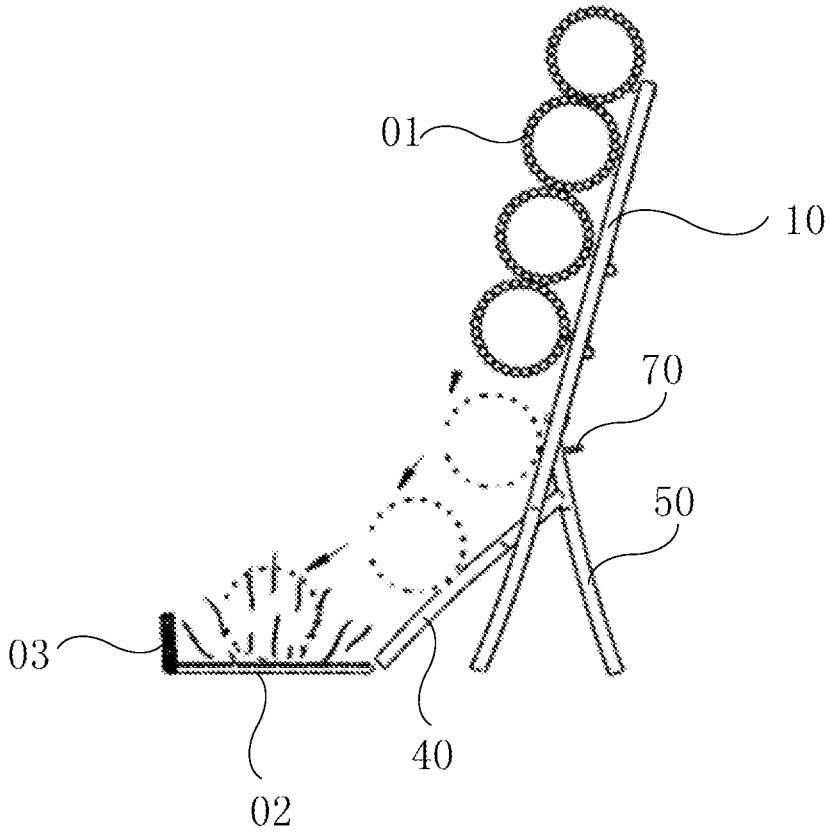
FIG. 8 is a structural diagram of another automatic firewood feeding device provided by embodiments of the present disclosure.

As shown in FIG. 8, the automatic firewood feeding device can further comprise a guiding member 40, which is configured to guide the firewood bundles 01 that are detached from the rack into the fire 02.

Specifically, the guiding member 40 can be configured such that a side thereof that is close to the rack 10 is placed higher than a side thereof that is far away from the rack 10. A slope is thereby formed between the guiding member 40 and the ground, so that the firewood bundles 01 detached from the rack 10 can fall from the side of the guiding member 40 that is close to the rack 10, roll to the side of the guiding member 40 that is far away from the rack 10 along the extending direction of the guiding member 40, and finally fall into the fire 02.

On this above basis, in order to prevent the firewood bundles 01 from traveling over, and subsequently falling outside, the fire 02 after detaching from the rack 10 and rolling off the guiding member 40, a baffle board 03 can be arranged on the ground at a side of the fire 02 that is opposing to the rack 10 (i.e. a side of the fire 02 that is far away from the rack 10), so as to baffle the firewood bundles 01 detaching from the rack 10 to thereby prevent them from passing over the fire 02.

Herein the baffle board 03 can have a composition of aluminum alloy, or can comprise stone pieces that are obtained locally. The height of the baffle board 03 can be around 200 mm, and can be set at a different height depending on specific embodiments, as long as the baffle board 03 can effectively block the falling-off of the firewood bundles 01. There are no limitations herein.

In order to improve the guiding function of the guiding member 40 to thereby prevent the firewood bundles 01 on the guiding member 40 from falling, the guiding member 40 can comprise a plurality of guiding bars which are arranged to be parallel to one another. Alternatively, the guiding member 40 can comprise a guiding plane.

In the automatic firewood feeding device as described above, the guiding member 40 can be configured to have a curved shape along the direction from the rack 10 to the fire 02 to thereby ensure a stable rolling of the firewood bundles 01 on the guiding member 40. In some preferred embodiment, the guiding member 40 can be curved towards a ground.

In order to improve a guiding function of the guiding member 40, the guiding member 40 can include a plurality of guiding rods that are aligned in parallel according to some embodiments, or can include one guiding board according to some other embodiments.

In some embodiments, the automatic firewood feeding device further includes an ancillary support bar 50, as illustrated in FIG. 8. The ancillary support bar 50 is disposed at a side of the rack 10 that is opposing to the guiding member 40 (i.e. the ancillary support bar 50 and the guiding member 40 are respectively disposed at the two opposing sides of the rack 10).

The ancillary support bar 50 is configured such that one end thereof that is close to the rack 10 (i.e. the end attaching the rack 10) is arranged to be higher than the other end thereof that is far away from the rack 10 (i.e. the end touching the ground), so as to form a slope with the ground. Such a configuration substantially allows the ancillary support bar 50 to provide a support to the rack 10 at the side of the rack 10 that is opposite to the fire 02, improving a stability of the rack 10 on the ground.

The ancillary support bar 50 can be configured to be a part attaching on the guiding member 40 as shown in FIG. 9 (i.e., the ancillary support bar 50 and the guiding member 40 are integrated into one piece), and can also be configured as a separate and independent component from the guiding member 40 that can be assembled during deployment and dissembled otherwise.

It is noted that besides the embodiment as illustrated in FIG. 9, where a rod-like ancillary support bar 50 is employed to provides a support to the rack 10 after being deployed on a side of the rack 10 opposing to the guiding member 40, other types of support are also possible, which can be provided by various other embodiments of the present disclosure.

In one illustrating example, the rack 10 can be configured to have a shape of "L", with one arm configured to hold the firewood bundles and the other arm configured to sufficiently touch the ground. The rigid structure of the "L"-shaped rack 10 is configured to provide support to allow the one arm of the rack 10 holding the firewood bundles 01 to stand on the ground.

In the automatic firewood feeding device as shown in FIG. 9, the controller 30 receives a temperature detected by the temperature sensor 60 to thereby generate a feeding command. As such, in order to improve the detection accuracy of the temperature sensor 60, the temperature sensor 60 can be disposed at a side of the ancillary support bar 50 that is closer to the rack 10, or at a side of the guiding member 40 that is closer to the rack 10.

Because the guiding member 40 needs to be configured at the very bottom of the rack 10 to best realize the guiding function, and the ancillary support bar 50 needs also to be configured at the bottom of the rack 10, thus if the temperature sensor 60 is arranged on the ancillary support bar 50 (as shown in FIG. 9) or on the guiding member 40, the distance between the guiding member 40 or the ancillary support bar 50 and the fire 02 is relatively short, resulting in a relatively short distance between the temperature sensor 60 and the fire 02. Such a configuration and arrangement is beneficial to improve the detection accuracy of the temperature sensor 60.

In addition, by arranging the temperature sensor 60 at the side of the guiding member 40 or the ancillary support bar 50 that is closer to the rack 10, the issue where a too short distance between the temperature sensor 60 and the fire 02 adversely influences the detection accuracy of the temperature sensor 60 due to a relatively too high temperature at the short distance can be effectively avoided.

Figure 10A:
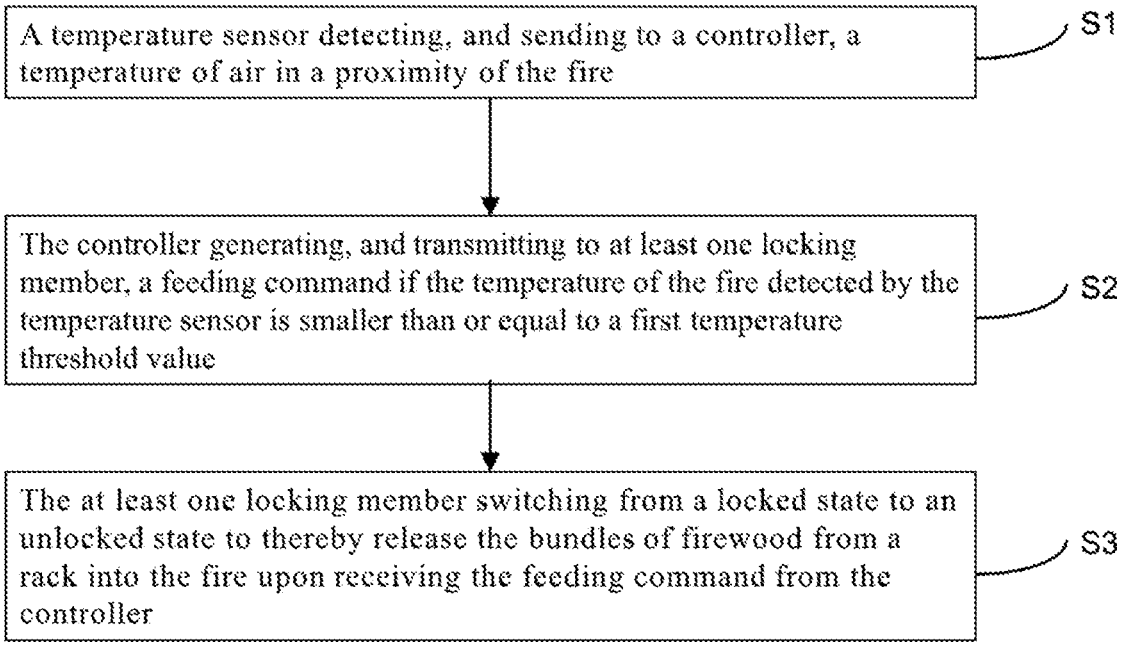
FIG. 10A is a flow chart showing a method for automatically feeding firewood utilizing the automatic firewood feeding device as described above.

As such, if the automatic firewood feeding device comprises the temperature sensor 60, the method for automatically feeding bundles of firewood to a fire utilizing the automatic firewood feeding device as described above can include the following steps, as illustrated in FIG. 10A.

S1: a temperature sensor detecting, and sending to a controller, a temperature of air in a proximity of the fire;

S2: the controller generating, and transmitting to at least one locking member, a feeding command if the temperature of the fire detected by the temperature sensor is smaller than or equal to a first temperature threshold value; and S3: the at least one locking member switching from a locked state to an unlocked state to thereby release the bundles of firewood from a rack into the fire upon receiving the feeding command from the controller.

Figure 10B:
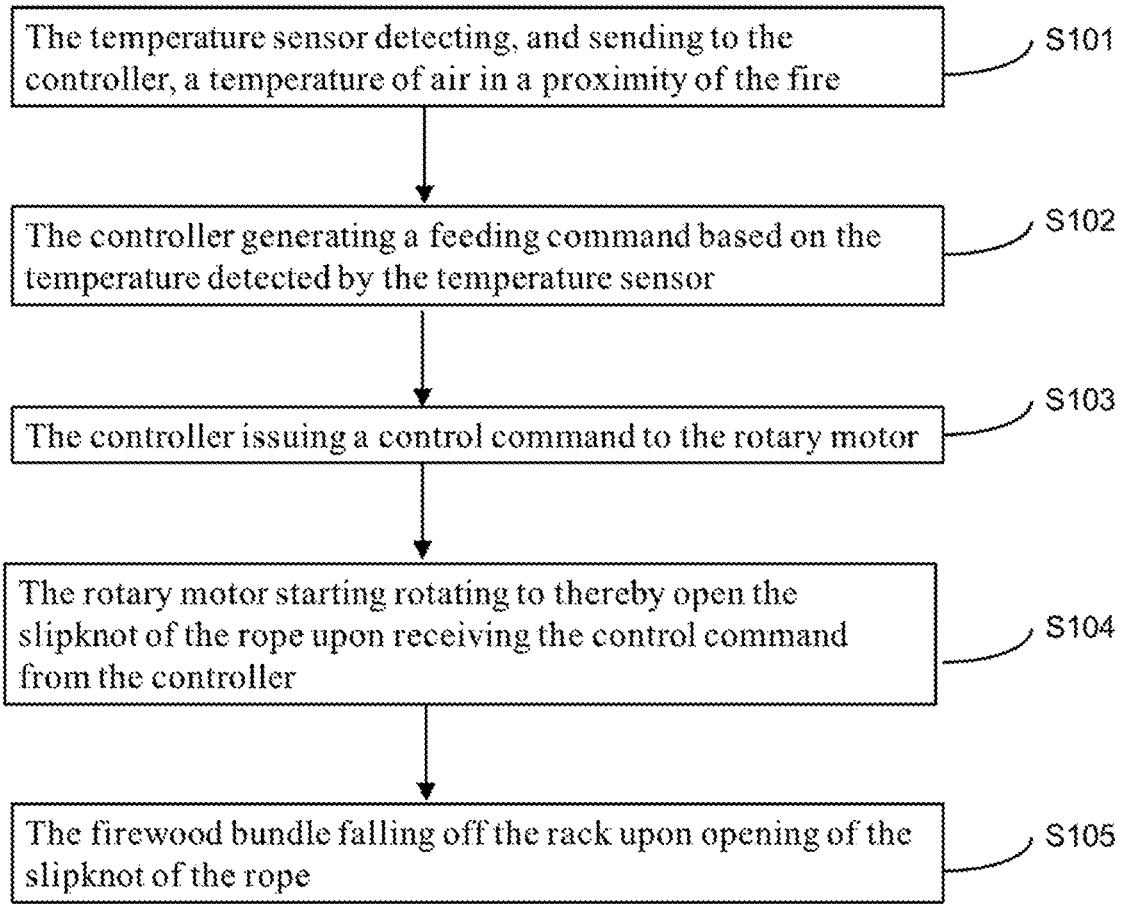
FIG. 10B is a flow chart illustrating a specific control process for feeding firewood by means of an automatic firewood feeding device according to some specific embodiment.

FIG. 10B illustrates one specific method utilizing the automatic firewood feeding device according to some specific embodiment as described above. As shown in FIG. 10B, the method includes the following steps:

S101: the temperature sensor 60 detecting, and sending to the controller, a temperature of air in a proximity of the fire 02;

Substantially in this step, the temperature sensor 60 detects a temperature of air in the proximity of the fire 02 and outputs the detection result to the controller 30.

S102: the controller 30 generating a feeding command based on the temperature detected by the temperature sensor 60;

Specifically, if the temperature detected by the temperature sensor 60 and received by the controller 30 is smaller or equal to the first temperature threshold value T1, the controller can be configured to generate the feeding command. Herein the range of the first threshold values T1 is 150° C.–250° C.

S103: the controller 30 issuing a control command to the rotary motor 201;

S104: the rotary motor 201 starting rotating to thereby open the slipknot 2021 of the rope upon receiving the control command from the controller 30;

Specifically, when the rotary motor 201 starts rotating, the opening end of the slipknot 2021 is pulled to thereby open the slipknot 2021, as shown in FIG. 6.

S105: the firewood bundle 01 falling off the rack upon opening of the slipknot 2021 of the rope.

Specifically, when the slipknot 2021 is opened, as shown in FIG. 7, the rope 202 that is wound over the firewood bundle 01 releases the firewood bundle 01, the firewood bundle 01 is separated from the crossbeam and fall into the fire 02 under the influence of the gravity.

When all firewood bundles 01 fastened on the rack 10 have fallen into the fire 01, the firewood feeding process cannot be sustained. Under this situation, the temperature of the fire 02 decreases gradually until the fire is out.

Therefore, in order to prevent the fire 02 from being completely out, as shown in FIG. 8, the automatic firewood feeding device can further include an alarming device 70, configured to generate an alarm to remind people of the situation according to some embodiments of the present disclosure. The alarming device 70 can be disposed at a side of the ancillary support bar 50 that is far away from the fire 02, and can be coupled to the temperature sensor 60.

In the above mentioned embodiments, the controller 30 is further configured to issue an alarming command to the alarming device 70 if the temperature detected by the temperature sensor 60 is smaller than or equal to a second temperature threshold value T2. The alarming device 70 is configured, upon receiving the alarming command from the controller 30, to generate the alarm.

Herein, the range of the second temperature threshold values T2 can be 45° C.-60° C.; and the alarming device 70 can be a buzzer that makes a noise to thereby transmitting the alarm. Other embodiments are also possible.

As for the embodiments of the automatic firewood feeding device shown in FIG. 6 or FIG. 8, the automatic firewood feeding device can include two main support portions 101 (weight: 0.55 kg×2=1.1 kg; length: 350 mm when folded; and composition: aluminum alloy), five fastening portions 102 comprising five crossbeams (weight: 0.08 kg×5=0.4 kg; composition: aluminum alloy), one ancillary support bar 50 (weight: 0.1 kg; composition: aluminum alloy), one guiding member 40 comprising two guiding rods (weight: 0.1 kg×2=0.2 kg; composition: aluminum alloy); rotary motors 201 (weight: 0.05 kg×5=0.25 kg; diameter: 20 mm; length: 25 mm), batteries 203 (battery model 18650, configured to support a single rotary motor to rotate for one hour, weight: 0.02 kg×2=0.04 kg), a temperature sensor 60 (weight: ignored), and an alarming device 70 (weight: ignored).

Under this above circumstance, the total weight of the automatic firewood feeding device is about 2 kg, therefore it is convenient for carrying.

In some embodiments where each locking member 20 includes a rotary motor 201 and a rope 202, the following provides an approach for the locking member 20 to fasten the firewood bundle 01 over the rack 10 in the locked state, and to detach the firewood bundle 01 from the rack 10 in the unlocked state.

The rope 202 is wound around the firewood bundle 01, with one end thereof mounted on the crossbeam (i.e., the fastening portion 102), and the other end thereof directly attached to the rotating axis of the rotary motor 201.

When the locking member 20 is in the locked state, the rotating axis of the rotary motor 201 rotates in a first direction (for example, clock-wise direction) so that the rope 202 can be tightened up until reaching a predetermined location to thereby fasten the firewood bundle 01 over the crossbeam.

When the locking member 20 is in the unlocked state, the rotating axis of the rotary motor 201 rotates in a second direction (for example, counter clock-wise direction), so that the rope 202 can be loosened as shown in FIG. 7 to thereby release the firewood bundle 01, which then rolls off the rack 10 and falls into the fire 02 under the influence of gravity.

In some other embodiments where in addition to a rope 202, each locking member 20 further includes a first electromagnet and a second electromagnet (not shown in the drawings), the following provides another approach to realize the function of the locking member 20 to fasten the firewood bundle 01 over the rack 10 in a locked state, and to detach the firewood bundle 01 from the rack 10 in the unlocked state.

The rope 202 is wound around the firewood bundle 01, with one end thereof mounted on the crossbeam (i.e., the fastening portion 102), and the other end thereof attached to the first electromagnet. The second electromagnet is mounted on the crossbeam.

When the locking member 20 is in the locked state, the first electromagnet and the second electromagnet are charged, such that the first electromagnet and the second electromagnet are attracted to each other to thereby fasten the firewood bundle 01 over the crossbeam.

When the locking member 20 is in the unlocked state, because the first electromagnet and the second electromagnet are not charged, the first electromagnet and the second electromagnet are not attracted to each other and get separated, so that the rope 202 can be loosened as shown in FIG. 7 to thereby release the firewood bundle 01, which then rolls off the rack 10 and falls into the fire 02 under the influence of gravity.

Embodiment 2

Figure 11:
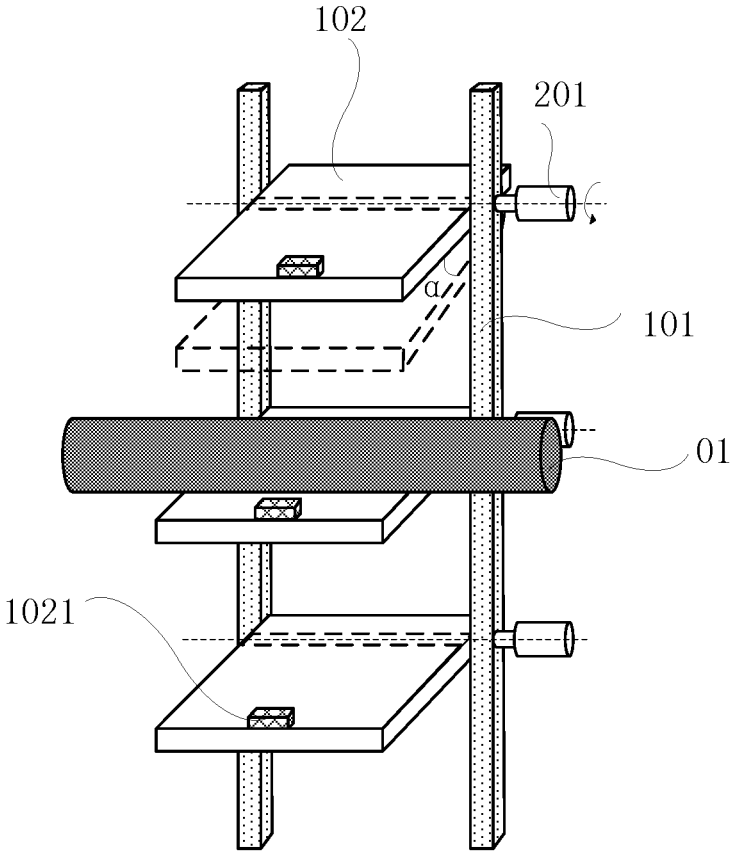
FIG. 11 is a structural diagram of yet another automatic firewood feeding device provided by embodiments of the present disclosure.

In this embodiment, as shown in FIG. 11, the plurality of fastening portion 102 substantially comprise a plurality of support panels. Each fastening portion 102 comprises a support panel, configured to be hinged on the two main support portions 101, with a hinge axis perpendicular to the main support portions 101.

Each locking member 20 includes a rotary motor 201, with a rotating axis of the rotary motor 201 on the hinge axis of the support panel. The rotary motor 201 is coupled to the controller 30, as shown in FIG. 1

When the locking members 20 are all in the locked state, the plurality of support panels can be configured to be parallel to the ground, so that the firewood bundles 01 can be placed stably on the support panels.

When there is a need for supplementing firewood to the fire 02, the controller 30 can generate a control signal according to a feeding command, then the control signal can be sent to the rotary motor 201 through a wired or wireless (e.g., Bluetooth, wireless, or LAN, etc.) approach to thereby control the rotating axis of the rotary motor 201 to rotate in a first direction (indicated by the arrow as shown in FIG. 11).

Rotation of the rotating axis of the rotary motors 201 causes the support panel 102 to rotate for a certain angle (e.g., $\alpha°$), in turn causing the locking member 20 to be in the unlocking state. Consequently, the firewood bundles 01 cannot be kept stable over the support panel, and are thus released from the support panels under the influence of gravity to ultimately fall into the fire 02.

In order to improve the stability of the firewood bundles 01 on the support panels when the locking members are in the locked state, according to some embodiments of the present disclosure, each of the support panels is configured to comprise an anti-skidding portion on a top surface thereof (i.e. the surface of the support panels for place the firewood bundles 01 thereon).

Specifically, as shown in FIG. 11, the anti-skidding portion comprises at least one barrier 1021, which is configured to block the firewood bundles 01 from falling off the support panels. Optionally, the anti-skidding portion can further comprise a plurality of stripes on the top surface of the support panels, configured to increase the roughness of the surfaces to thereby allow the firewood bundles 01 to be stably placed on the support panels.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A device for automatically feeding a material to a target place, comprising:

a rack;

at least one locking member, attached onto the rack; and a controller;

wherein:

each of the at least one locking members is configured to maintain a bundle of the material onto the rack in a locked state, and to release the bundle of the material from the rack in an unlocked state;

the controller is coupled to, and configured to control, each of the at least one locking member to be in the unlocked state based on a feeding command;

the material is firewood, and the target place is a fire;

the rack comprises at least one main support portion and at least one fastening portion;

the at least one main support portion stands on a ground and beside the fire;

each of the at least one fastening portion is mounted onto the at least one main support portion and is configured to fasten a bundle of firewood thereonto; and one of the at least one locking member is attached onto each of the at least one fastening portion.

2. The device of claim 1, further comprising a temperature sensor, disposed on the rack and coupled to the controller, wherein:

the temperature sensor is configured to detect, and send to the controller, a temperature of air in a proximity of the fire; and the controller is further configured to generate the feeding command if the temperature of the fire detected by the temperature sensor is smaller than or equal to a first temperature threshold value.

3. The device of claim 2, wherein the first temperature threshold value is in a range of around 150° C.-250° C.

4. The device of claim 1, wherein the controller comprises a timer, configured to trigger the controller to generate a feeding command at a preselected time interval.

5. The device of claim 1, wherein:

the at least one main support portion comprises two and more main support portions in parallel to one another; and the at least one fastening portion is disposed between two adjacent main support portions.

6. The device of claim 5, wherein:

each of the at least one fastening portion comprises a crossbeam; and each of the at least one locking member comprises a rope, attached to a crossbeam corresponding thereto, wherein the rope is configured:

to be wound around a bundle of firewood to thereby fasten the bundle of firewood on the crossbeam in the locked state; and to be loosened to thereby release the bundle of firewood from the crossbeam in the unlocked state.

7. The device of claim 6, wherein each of the at least one locking member further comprises a rotary motor, wherein:

the rotary motor is coupled to the controller, and is configured to rotate in a first direction in the locked state and to rotate in a second direction in the unlocked state;

the rope is configured to have one end thereof mounted onto the crossbeam and another end thereof bound onto the crossbeam through a slipknot in the locked state, wherein the another end is wound around a rotating axis of the rotary motor such that:

rotation of the rotary motor in the first direction tightens the rope to thereby fasten the bundle of firewood on the crossbeam in the locked state; and rotation of the rotary motor in the second direction pulls open the slipknot to thereby release the bundle of firewood from the crossbeam in the unlocked state.

8. The device of claim 6, wherein each the at least one locking member further comprises two electromagnets, wherein:

one of the two electromagnets is attached to one end of the rope, and another one of the two electromagnets is mounted onto the crossbeam;

the two electromagnets are coupled to the controller, and are configured:

to be charged to attract each other to thereby fasten the bundle of firewood on the crossbeam in the locked state; and to be uncharged to lose attraction to each other to thereby release the bundle of firewood from the crossbeam in the unlocked state.

9. The device of claim 5, wherein each of the at least one fastening portion comprises a support panel, wherein:

the support panel is hinged on, and have a hinge axis perpendicular to, two adjacent main support portions; and the support panel is configured to be in a position fastening the bundle of firewood thereon in the locked state, and to rotate around the hinge axis in one direction to thereby release the bundle of firewood therefrom in the unlocked state.

10. The device of claim 9, wherein each of the at least one locking member comprises a rotary motor, wherein:

the rotary motor is attached to the support panel and is configured to rotate to thereby carry the support panel to rotate around the hinge axis thereof; and the rotary motor is coupled to the controller and is configured to rotate in the one direction in the unlocked state.

11. The device of claim 1, further comprising an alarming device, wherein:

the alarming device is coupled to the controller, and is configured to generate an alarm upon receiving an alarming command from the controller; and the controller is further configured to generate an alarming command if the temperature of the fire detected by the temperature sensor is smaller than or equal to a second temperature threshold value.

12. The device of claim 11, wherein the second temperature threshold value is in a range of around 45° C.-60° C.

13. The device of claim 1, further comprising at least one guiding member, wherein:

each of the at least one guiding member is disposed between the fire and the rack such that one end thereof pointing to the rack is placed higher than another end thereof pointing to the fire; and each of the at least one guiding member is configured to guide the bundle of firewood released from the rack to roll into the fire.

14. The device of claim 13, further comprising at least one baffle board, wherein:

each of the at least one baffle board is disposed on a ground, in a guiding direction of one guiding member, and at a side of the fire opposing to the rack, and is configured to baffle the bundle of firewood rolling off the one guiding member to thereby prevent the bundle of firewood from falling off the fire.

15. A device for automatically feeding a material to a target place, comprising:

a rack;

at least one locking member, attached onto the rack; and a controller;

wherein:

each of the at least one locking members is configured to maintain a bundle of the material onto the rack in a locked state, and to release the bundle of the material from the rack in an unlocked state;

the controller is coupled to, and configured to control, each of the at least one locking member to be in the unlocked state based on a feeding command; and the material is firewood, and the target place is a fire;

the device further comprising at least one ancillary support bar, wherein:

each of the at least one ancillary support bar is disposed on a side of the rack opposing to the fire such that one end thereof attaching the rack is higher than another end thereof touching the ground; and each of the at least one ancillary support bar is configured to support the rack.

16. The device of claim 1, wherein each of the at least one main support portion is configured to have an adjustable length.

17. The device of claim 5, wherein:

the at least one main support portion comprises three and more main support portions in parallel to one another; and the at least one fastening portion is disposed between every two adjacent main support portions, wherein:

every two adjacent planes formed by each three adjacent main support portions are configured to have an angled corner pointing to a direction far away from the fire.

* * * * *